US009959988B2

(12) United States Patent
Pan et al.

(10) Patent No.: US 9,959,988 B2
(45) Date of Patent: May 1, 2018

(54) POSITION LOCKING AND SHIFTING CONTROL MECHANISM

(71) Applicants: SHANGHAI ELECTRICIAN INDUSTRY & COMMERCE CO., LTD., Shanghai (CN); SHANGHAI PUHE TECHNOLOGY CO., LTD., Shanghai (CN)

(72) Inventors: Haifeng Pan, Shanghai (CN); Xiaoping Chen, Shanghai (CN)

(73) Assignees: SHANGHAI ELECTRICIAN INDUSTRY & COMMERCE CO., LTD., Shanghai (CN); SHANGHAI PUHE TECHNOLOGY CO., LTD., Shanghai (CN)

( * ) Notice: Subject to any disclaimer, the term of this patent is extended or adjusted under 35 U.S.C. 154(b) by 0 days. days.

(21) Appl. No.: 15/106,287

(22) PCT Filed: Dec. 26, 2013

(86) PCT No.: PCT/CN2013/090542

§ 371 (c)(1),
(2) Date: Jun. 18, 2016

(87) PCT Pub. No.: WO2015/096087

PCT Pub. Date: Jul. 2, 2015

(65) Prior Publication Data

US 2016/0322176 A1 Nov. 3, 2016

(51) Int. Cl.
*H01H 3/00* (2006.01)
*H01H 9/20* (2006.01)
(Continued)

(52) U.S. Cl.
CPC ..... *H01H 9/20* (2013.01); *H01H 9/285* (2013.01); *H01H 3/227* (2013.01); *H01H 9/223* (2013.01)

(58) Field of Classification Search
CPC ..... H01H 9/20; H01H 9/285; H01H 9/223; H01H 3/227
(Continued)

(56) References Cited

U.S. PATENT DOCUMENTS 1,687,490 A * 10/1928 Briggs ..... H01H 9/285 200/43.11
4,227,056 A * 10/1980 Johnston ..... H01H 9/285 200/4
(Continued)

FOREIGN PATENT DOCUMENTS

CN 101274618 A 10/2008
CN 103714991 A 4/2014
(Continued)

*Primary Examiner* — Edwin A. Leon
*Assistant Examiner* — Lheiren Mae A Caroc
(74) *Attorney, Agent, or Firm* — Im IP Law; C. Andrew Im

(57) ABSTRACT

A position lock and position shift controlling mechanism for a multi-position shifting switch includes a position lock and position shift assembly and a controlling assembly to control the locking of the position lock and position shift assembly. The position lock assembly includes a locked body, a moving body and a housing body. The locked body includes a roundel pedestal which rotates synchronously with a switching shaft, a lock tooth component rotatably attached with the roundel pedestal, and an inner core component. The lock tooth component includes evenly distributed location teeth and plural radial slots. The moving body locks the lock tooth component and pushes the inner core component away from the lock tooth component. The switching shaft actuates the roundel pedestal to rotate a preset angle about the lock tooth component to shift the multi-position shifting switch to a stop control mode position from an automation control mode position.

6 Claims, 12 Drawing Sheets

(51) Int. Cl.

| | |
|---|---|
| ***H01H 9/28*** | (2006.01) |
| *H01H 3/22* | (2006.01) |
| *H01H 9/22* | (2006.01) |

(58) Field of Classification Search
USPC .... 200/43.04, 43.08, 43.11, 43.16, 321, 322, 200/327
See application file for complete search history.

(56) References Cited

U.S. PATENT DOCUMENTS

| | | | | |
|---|---|---|---|---|
| 6,952,059 | B1 | 10/2005 | Louvel et al. | |
| 2015/0027861 | A1* | 1/2015 | Hoskins | F16H 59/08 200/43.11 |

FOREIGN PATENT DOCUMENTS

| | | | |
|---|---|---|---|
| CN | 203690153 | U | 7/2014 |
| WO | 2009031224 | A1 | 3/2009 |

* cited by examiner

POSITION LOCKING AND SHIFTING CONTROL MECHANISM

RELATED APPLICATIONS

This application is a § 371 application from PCT/CN2013/090542 filed Dec. 26, 2013, which is incorporated herein by reference in its entirety.

FIELD OF THE INVENTION

The present invention relates to a position lock and position shift controlling mechanism, especially relates to a position lock and position shift controlling mechanism which performs a position lock and position shift controlling with respect to a multi-position shifting switch.

BACKGROUND OF THE INVENTION

A multi-position shifting switch is a switch, which can perform a shift connection with respect to two or more electric powers or two or more loads, and can control the operation of plural equipments, further is widely utilized in daily lives and industrial production such as power stations, orbit stations, high-speed railway locomotives, subway locomotives and ships. The switch generally comprises positions of plural manual control modes and a stop control mode. A locking mechanism of the multi-position shifting switch is a main carrier and significant part to protect the switch, and to avoid misoperation after the multi-position shifting switch is shifted into a specific mode position. A lock function of the locking mechanism is one of the important indicators to judge whether it is excellent or not that the performance of the locking mechanism. With the acceleration of development in industrialization and informatization, equipments automatically controlled by computers are widely applied in electrical control area, therefore the multi-position shifting switch should also comprise an automation control mode position, that the operation of equipments could be controlled by computers. And when the equipments need to be emergency stopped while the multi-position shifting switch is in the automation control mode, the multi-position shifting switch should be able to shift from the automation control mode position into a stop control mode position.

As shown by FIG. 18, prior art discloses a locking mechanism 300, which performs a lock controlling with respect to the control mode positions in the multi-position shifting switch. When the locking mechanism locks the multi-position shifting switch into the automation control mode position, a key needs to be inserted into a key cylinder 301 and rotated to actuate a controlling cam 302, whose protrusion is thus deflected towards a locked body 307 and pushes a moving body 303 towards a resist convex component 305. Then a mesh top 304 on the moving body 303 is actuated to mesh with a location tooth 308 on the locked body 307, therefore a position shift based on the coaxial rotation of the locked body 307 and a switching shaft 306 cannot be carried out. In such situation, manual operation on the operation modes cannot be accepted or responded. Such locking mechanism can prevent man-made misoperation on the equipments when the automation control mode is locked. In the case of emergency, when the multi-position shifting switch needs to be shifted into the stop control mode position from the automation control mode position immediately, the key needs to be inserted into the key cylinder 301 again, and then the protrusion of the controlling cam 302 is deflected away from the locked body 307. Thus the resist convex component 305 pushes the moving body 303 away from the locked body 307, and actuates the mesh top 304 on the moving body 303 to separate from the location tooth 308 on the locked body 307. Along with the coaxial rotation of the locked body 307 actuated by the switching shaft 306, the multi-position shifting switch is consequently shifted into the stop control mode position from the automation control mode position. However, with respect to such locking mechanism, once the multi-position shifting switch is locked in the automation control mode, without the key the multi-position shifting switch cannot be shifted into the stop control mode position, that all the equipments can be stopped. So in the case of emergency such as barriers appear right in front of high-speedy running railway trains or subway trains, which need to be emergency stopped, since the multi-position shifting switch with the aforesaid locking mechanism cannot be shifted without the key, the equipments cannot be stopped and a disastrous consequence may occur such as equipments trouble, equipments paralysis even casualties. Therefore, such locking mechanism is not suitable for the multi-position shifting switch provided with the automation control mode position, that the operation of equipments is automatically controlled by the computer.

To overcome such disadvantage of above locking mechanism, a prior art solution is to add a protecting electric system into the circuit of the multi-position shifting switch, which makes the structure of the locking mechanism more complicated, and increases the cost of equipments manufacture, further is too tedious to install and utilize.

SUMMARY OF THE INVENTION

Targeting at the problems above, the present invention provides a position lock and position shift controlling mechanism for performing a position lock and position shift controlling with respect to a multi-position shifting switch, the aforesaid multi-position shifting switch connects with plural equipments and is provided with at least an automation control mode position which is used to make the operation mode of plural equipments to be controlled by a computer, a stop control mode position which is adjacent to the automation control mode position in a preset interval and is set to perform a stop with respect to the operation of the plural equipments, and a switching shaft which performs a position shift within the automation control mode position and the stop control mode position, comprising: a position lock and position shift assembly, which is utilized to lock the automation control mode position and to shift the multi-position shifting switch from the automation control mode position to the stop control mode position at such lock status; and a controlling assembly, which is utilized to perform a lock controlling with respect to the position lock and position shift assembly. Wherein the position lock and position shift assembly includes: a locked body, which is disposed on the switching shaft; and a moving body, which is controlled to move towards and then locks the locked body by the controlling assembly. The locked body is provided with: a roundel pedestal, which is disposed on the switch body, and rotates with the switching shaft synchronously, further is provided with a notch based on the preset interval; a lock tooth component, which is roundel-shaped and is rotatably attached with the roundel pedestal; and an inner core component, which is disposed between the roundel pedestal and the lock tooth component, and is utilized to make the roundel pedestal and the lock tooth component rotate in synchronism. The roundel pedestal is provided with an axial slot, which extends along a direction parallel with the axial direction of the switching shaft, and the axial slot is provided with a through-hole, which extends along the radial direction of the roundel pedestal. The lock tooth component is provided with: plural location teeth, which are evenly distributed with preset intervals; and plural radial slots, which are corresponding to each location tooth respectively. The inner core component is provided with: an axial projection, which is utilized to fit with the axial slot; a radial projection, which is utilized to fit with the radial slot; and a forcing member, which applies a force on the radial projection and inserts the radial projection into the radial slot. The moving body is provided with: a lock groove, which fit with the location tooth; and a pushing lever, which pushes the radial projection move along the through-hole. The controlling assembly is provided with a control cam, which pushes the moving body towards the locked body by means of rotation. The roundel pedestal and the lock tooth component can rotate in synchronism when the radial projection is fit into the radial slot. When the automation control mode position is set so that the notch aligns with the moving body and the moving body moves towards the locked body, the lock groove and the location tooth fit and lock each other, and the pushing lever pushes the axial projection so as to separate the radial projection from the radial slot, therefore the roundel pedestal can rotate freely about the lock tooth component. Once the switching shaft is rotated, the notch restricts the roundel pedestal rotates only an angle of the preset interval about the lock tooth component, and allows the axial projection to be fit into next the axial slot, the multi-position shifting switch is consequently shifted into the stop control mode position.

Further, the position lock and position shift controlling mechanism can be also provided with a setup fixation section, which is utilized to mount the switching shaft fixedly. The lock tooth component is further provided with a location hole section, which is rotatably fit with the setup fixation section.

Further, the position lock and position shift controlling mechanism can also has the following features: wherein the switching shaft is further provided with a manual control mode position, which is adjacent to the automation control mode position, and is disposed on the opposite side of the stop control mode position. In the lock tooth component, each the radial slot is further provided with a blocking section, which is utilized to prevent the axial projection being actuated to rotate towards the manual control mode position after the axial projection is separated from the axial slot.

Further, the position lock and position shift controlling mechanism can also has the following features: wherein the axial projection is provided with: a long location side portion, which is corresponding to the blocking section; a short location side portion, which is corresponding to a sidewall facing the blocking section of the radial slot; and an arc connection portion, which connects the long location side portion and the short location side portion.

Further, the position lock and position shift controlling mechanism can also has the following features: wherein the moving body is further provided with a mesh tooth on both sides of each lock groove. The lock tooth component is further provided with two mesh grooves, which are disposed on both sides of each the location tooth, and are corresponding to the mesh teeth.

Further, the position lock and position shift controlling mechanism can also has the following features: wherein the position lock and position shift assembly further includes a housing body 3, which is utilized to mount the locked body and the moving body. The housing body is provided with a box body, and a cover body which covers the box body. The box body is provided with a guiding groove, which is utilized to guide the pushing lever to move towards the axial projection; and a setup platform, which is utilized to mount the roundel pedestal so as to keep the roundel pedestal a distance from the bottom of the box body. The cover body is provided with a guiding rail, which is in the same direction as the guiding groove, and is utilized to guide the guiding groove to move towards the location tooth.

The Effect of the Present Invention

According to position lock and position shift controlling mechanism provided in the present invention, when the multi-position shifting switch is shifted and locked into the automation control mode position, the lock groove fit with the location tooth, thus the lock tooth component is locked by the moving body and cannot move. Meanwhile the pushing lever pushes the axial projection towards the switching shaft, and actuates the radial projection of the inner core component to separate from the radial slot, therefore the roundel pedestal can rotate about the lock tooth component. In the case of emergency, if the key was lost, or the key cannot be inserted in time, or the key cannot be inserted, the switching shaft can be rotated and can actuate the roundel pedestal to rotate about the lock tooth component from the automation control mode position to the stop control mode position. After the multi-position shifting switch is shifted into the stop control mode position, the lock tooth component is locked by the moving body, so the switching shaft cannot be rotated to shift the position, thus the multi-position shifting switch is locked in the stop control mode position. After the emergency is relieved, the key can be inserted into the controlling assembly and can actuate the controlling cam to deflect and to separate the moving body from the lock tooth component. Therefore the switching shaft can be rotated and the multi-position shifting switch is unlocked from the stop control mode position. Therefore, the present invention provides a position lock and position shift controlling mechanism, which can shift the multi-position shifting switch from the automation control mode position to the stop control mode position, when the multi-position shifting switch is locked in the automation control mode position without the key to unlock. The position lock and position shift controlling mechanism thus can be applied in the multi-position shifting switch, which comprises the automation control mode position in which the operation of equipments can be controlled by computers.

DETAILED DESCRIPTION OF THE INVENTION

An embodiment of the invention will be described in detail herein below with reference to the figures.

Embodiment

Figure 1:
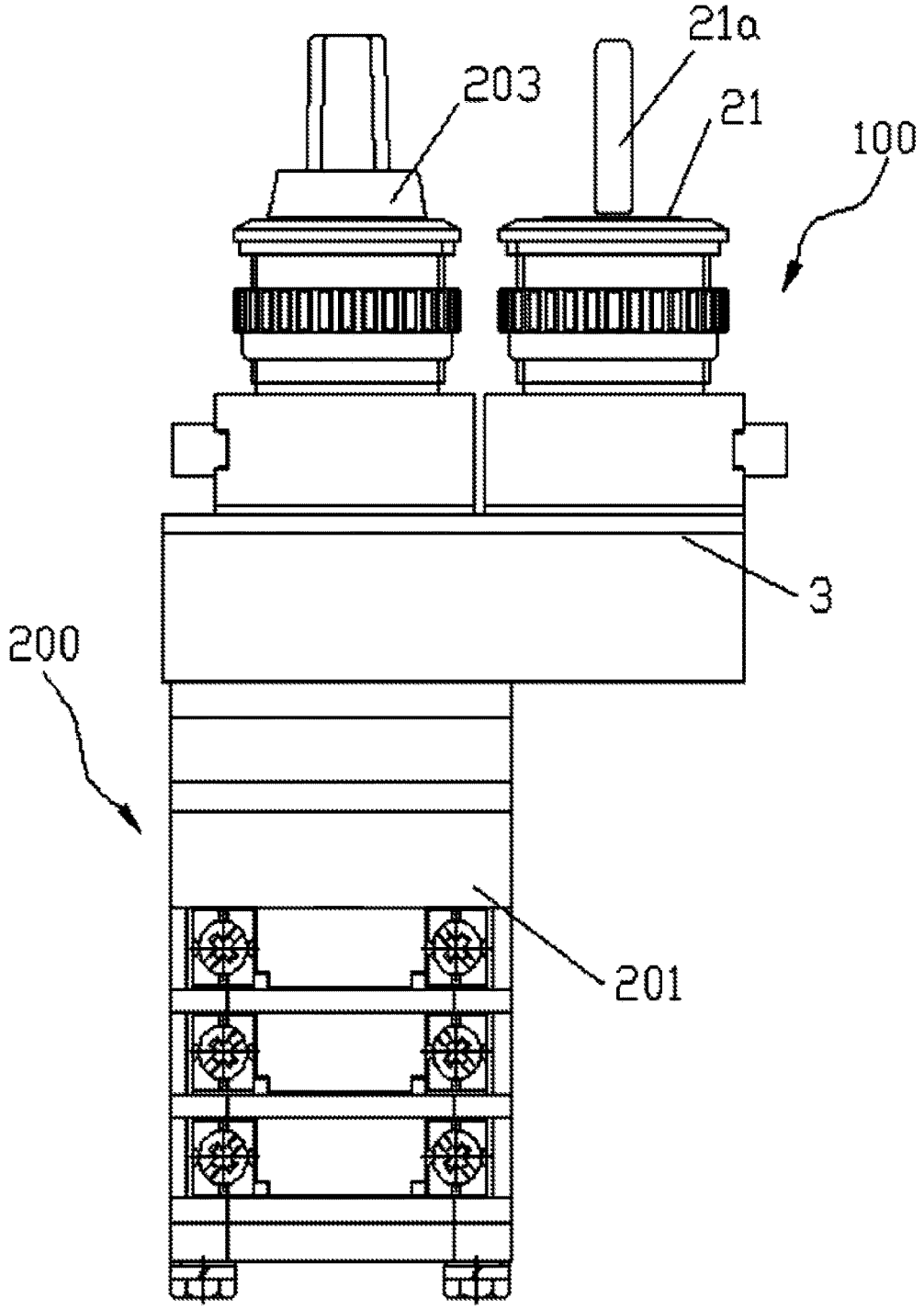
FIG. 1 is a diagram showing the connection between the position lock and position shift controlling mechanism and the multi-position shifting switch in the embodiment.

FIG. 1 is a diagram showing the connection between the position lock and position shift controlling mechanism and the multi-position shifting switch in the embodiment.

Figure 2:
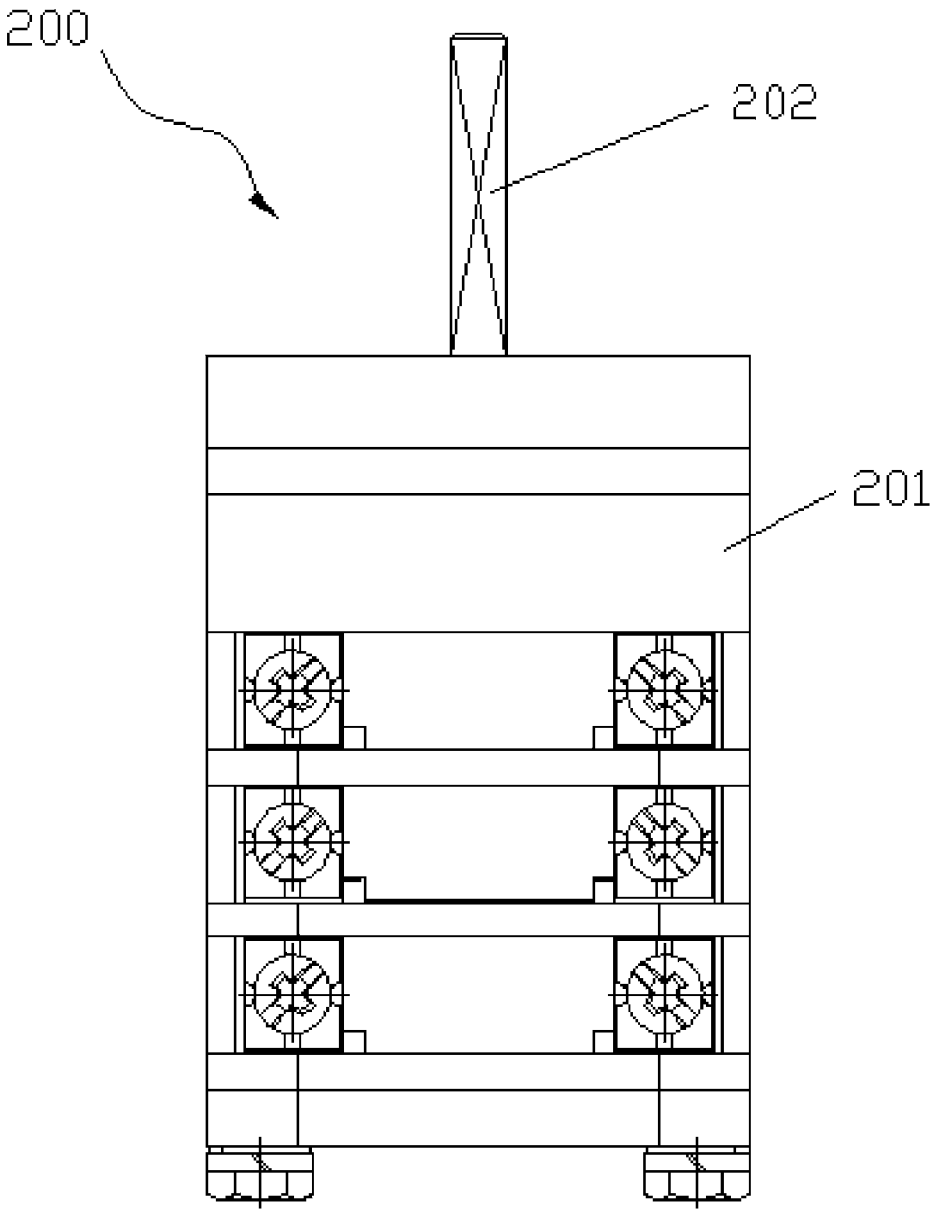
FIG. 2 is a structural illustration of the switch body in the embodiment.

FIG. 2 is a structural illustration of the switch body in the embodiment.

As shown in FIG. 1 and FIG. 2, a multi-position shifting switch 200 related in the present embodiment is provided with: a switch body 201, a switching shaft 202, and a position knob 203.

The switching shaft 202 is a square shaft, which extends from the inside to the top of the switch body 201. The position knob 203 is disposed above a position lock and position shift controlling mechanism 100 and covers the extension end of the switching shaft 202. And the left side of the position lock and position shift controlling mechanism 100 is penetrated by the switching shaft 202.

As shown in FIG. 1, the position lock and position shift controlling mechanism 100 is disposed between the switch body 201 and the position knob 203, and is utilized to perform a position lock and position shift of the multi-position shifting switch 200.

Figure 3:
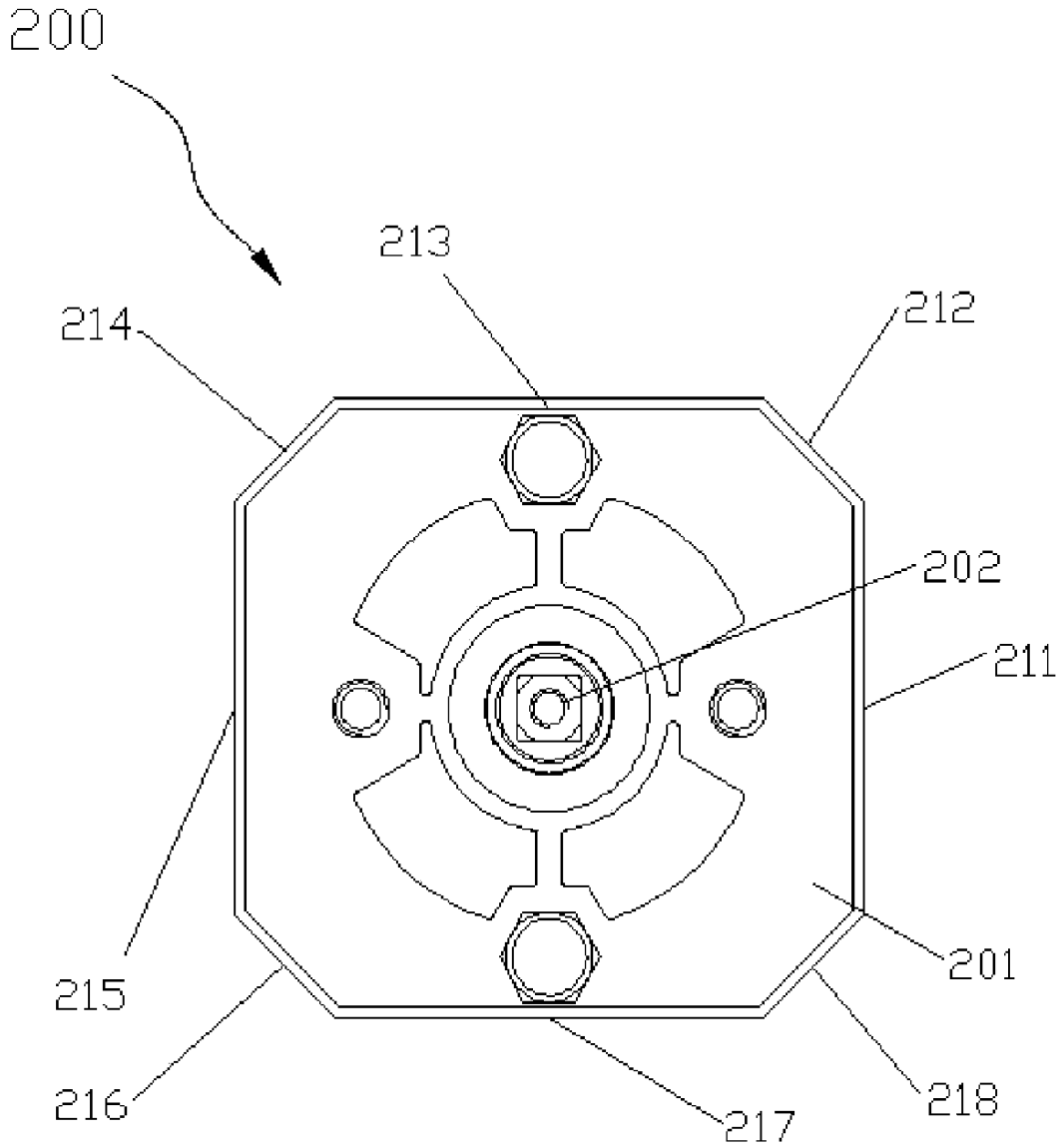
FIG. 3 is a top view of FIG. 2.

FIG. 3 is a top view of FIG. 2.

As shown by FIG. 3, the switch body 201 connects with plural unshown equipments, which are controlled by the switch itself. And the switch body 201 is provided with an automation control mode position 211, a stop control mode position 212 and a manual control mode positions group. All control mode positions are evenly distributed at preset intervals of 45 degree angle.

The automation control mode position 211 is disposed on the left part of the switch 201 and is set to make the operation mode of the equipments to be controlled by a computer. The stop control mode position 212 is adjacent to the automation control mode position 211 in a preset interval of 45 degree angle, and is set to stop the operation of plural equipments. A manual control mode positions group is composed of six manual control modes positions corresponding to different operation modes of equipments, and is set to make the operation of plural equipments to be controlled manually. The manual control mode positions group is anticlockwise provided with a first manual control mode position 213, a second manual control mode position 214, a third manual control mode position 215, a fourth manual control mode position 216, a fifth manual control mode position 217 and a sixth manual control mode position 218. The sixth manual control mode position 218 is adjacent to the automation control mode position 211, and is disposed on the opposite side of the stop control mode position 211.

When the multi-position shifting switch need to perform a position shift within the automation control mode position 211, the stop control mode position 211 and the manual control mode positions, the position knob 203 is rotated to actuate the switching shaft 202 rotate coaxially, and then the multi-position shifting switch 200 is shifted into the needed position.

Figure 4:
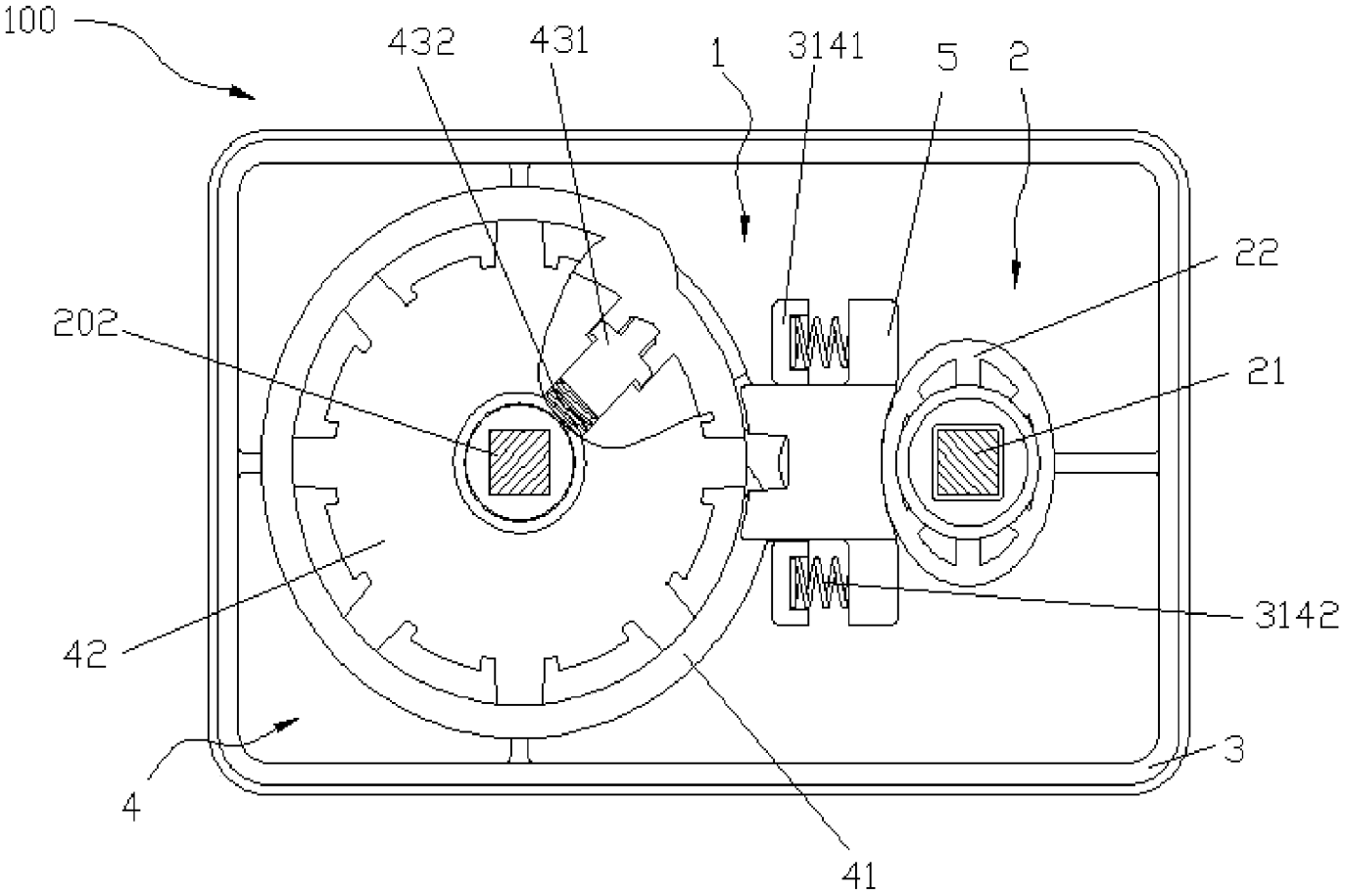
FIG. 4 is a structural illustration of the position lock and position shift controlling mechanism in the embodiment.

FIG. 4 is a structural illustration of the position lock and position shift controlling mechanism in the embodiment.

As shown in FIG. 4, the position lock and position shift controlling mechanism 100 includes a position lock and position shift assembly 1 and a controlling assembly 2, which is disposed oppositely to the position lock and position shift assembly 1.

The position lock and position shift assembly 1 is utilized to lock the multi-position shifting switch 200 into the automation control mode position 211 and to shift into the stop control mode position 212 from the automation control mode position 211 in such lock status. The controlling assembly 2 is corresponding to the automation control mode position 211 when the position lock and position shift controlling mechanism 100 is assembled onto the multi-position shifting switch 200.

The controlling assembly 2 is utilized to perform a lock control on the position lock and position shift assembly 1, and is provided with a key cylinder 21 and a control cam 22. The key cylinder 21 can be rotated by a key 21*a*. The control cam 22, which is oval-shaped, can be actuated to deflect by the key cylinder 21. When the controlling assembly 2 performs a lock control on the position lock and position shift assembly 1, the control cam 22 deflects a 45 degree angle and pushes a moving body 5 towards a locked body 4. When the controlling assembly 2 separates from the position lock and position shift assembly 1, the control cam 22 deflects to a vertical status as shown in the figure.

The position lock and position shift assembly 1 is provided with a housing body 3, a locked body 4 and a moving body 5. The housing body 3 is utilized to mount the controlling assembly 2 and the locked body 4.

The moving body 5 is located between the controlling assembly 2 and the locked body 4. The moving body 5 and the locked body 4 are disposed oppositely to each other. The moving body 5 closely contacts with the control cam 22. The moving body 5 is controlled by the controlling assembly 2, and can be moved towards the locked body 4 and then locks the locked body 4.

The position lock and position shift assembly 1 is disposed on the left side in the housing body 3. The controlling assembly 2 is disposed on the right side in the housing body 3 and contacts the locked body 4 oppositely.

The key cylinder 21 is disposed in parallel with the position knob 203. When the multi-position shifting switch 200 needs to be locked into the automation control mode position 211, the key 21*a* is rotated to actuate control cam 22 to deflect a 90 degree angle and to push the moving body 5 towards the locked body 4. Then the moving body 5 moves towards the left and locks the locked body 4, thus the multi-position shifting switch 200 is locked into the automation control mode position 211.

Figure 5:
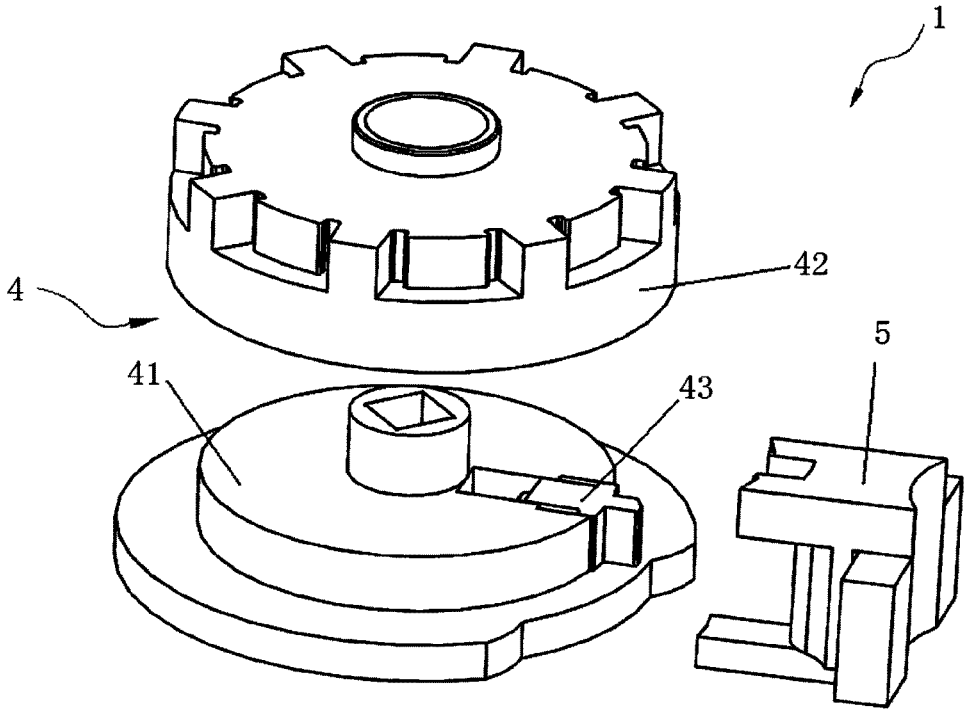
FIG. 5 is a part structure illustration of the position lock and position shift controlling mechanism in the embodiment.

FIG. 5 is a part structure illustration of the position lock and position shift controlling mechanism in the embodiment.

As shown by FIG. 4 and FIG. 5, the locked body 4 is disposed on the switching shaft 202, and is provided with a roundel pedestal 41, a lock tooth component 42 and an inner core component 43.

The roundel pedestal 41 is mounted on the switching shaft 202 and can rotate synchronously with the switching shaft 202. The lock tooth component 42 is rotatably attached with the roundel pedestal 41, and is exposed from the bottom of the roundel pedestal 41. The inner core component 43 is disposed between the roundel pedestal 41 and the lock tooth component 42, and is utilized to make the roundel pedestal 41 and the lock tooth component 42 rotate in synchronism.

The inner core component 43 is provided with a fit member 431 and a forcing member 432.

Figure 6:
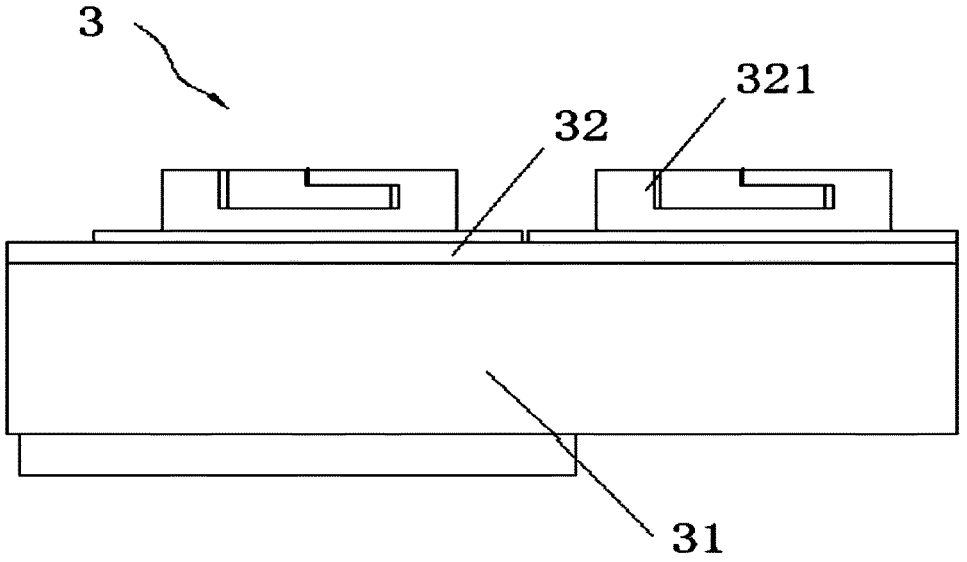
FIG. 6 is a front view of the housing body in the embodiment.

FIG. 6 is a front view of the housing body in the embodiment.

As shown in FIG. 6, the housing body 3 is provided with a box body 31 and a cover body 32.

The cover body 32 is disposed on the top of the box body 31, and is bonded with the box body 31 by screws. The sidewalls of the cover body 32 are aligned with the sidewalls of the box body 31. The cover body 32 covers the locked body 4 and the controlling assembly 2 into the box body 31.

Figure 7:
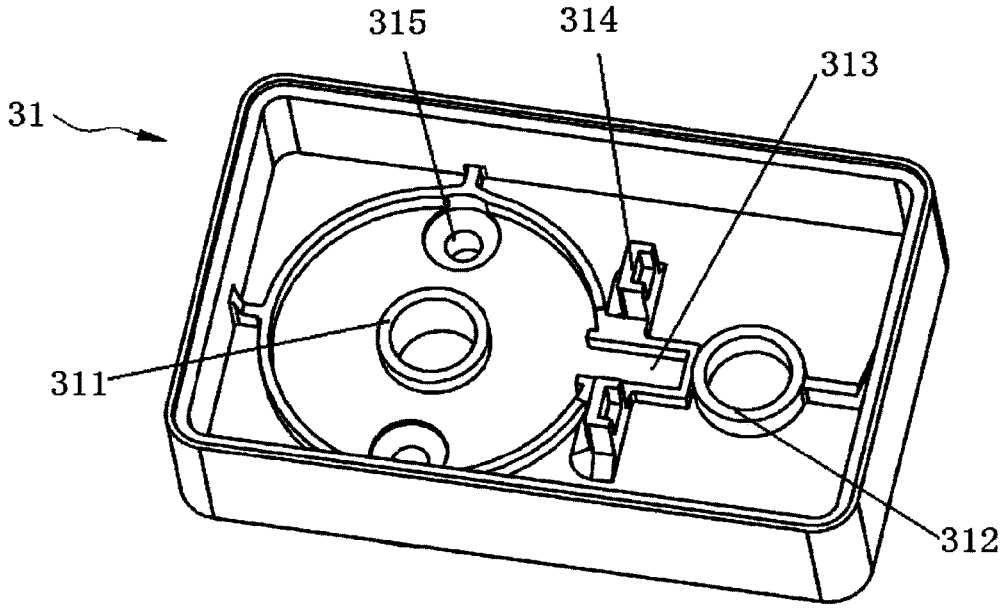
FIG. 7 is a structural illustration of the housing body in the embodiment.

FIG. 7 is a structural illustration of the housing body in the embodiment.

As shown in FIG. 7, the box body 31 is provided with an annular convex platform 311, an annular convex platform 312, a guiding groove 313, a pushing assembly 314 and a counterbore 315.

The annular convex platform 311 is disposed on the bottom left side of the box body 31, and the annular convex platform 312 is disposed on the bottom right side of the box body the box body 31. The annular convex platform 311 is utilized to mount the roundel pedestal 41 and to keep the roundel pedestal 41 a specific distance from the bottom of the box body 31. The annular convex platform 312 is utilized to bear control cam 22. A through hole is disposed in the center of the annular convex platform 311, and is penetrated by the switching shaft 202. The guiding groove 313 extends from the annular convex platform 312 to the annular convex platform 311. Two pushing assemblies 314 are disposed respectively on each side of the guiding groove 313, and are utilized to push the moving body 5 towards the controlling assembly 2. Each pushing assembly 314 includes a spring locating component 3141 and a pushing spring 3142. The pushing spring 3142 is disposed between the spring locating component 3141 and the moving body 5. A counterbore 315 is disposed respectively on each longitudinal side of the annular convex platform 311. A screw penetrates the counterbore 315 and then mounts the box body 31 onto the top surface of the switch body 201.

Figure 8:
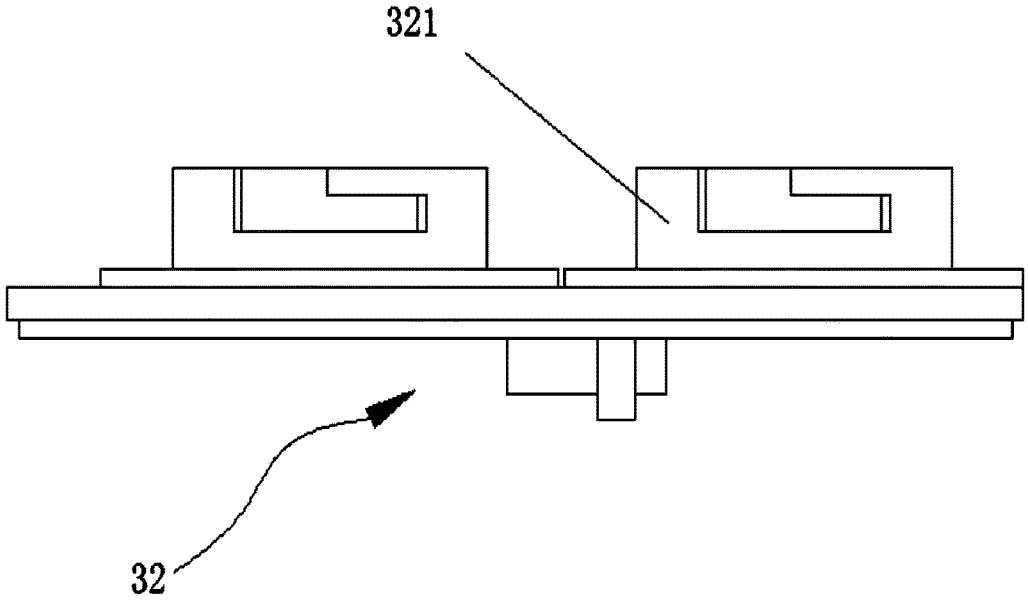
FIG. 8 is a front view of the cover body in the embodiment.

FIG. 8 is a front view of the cover body in the embodiment.

As shown in FIG. 8, the box body 31 is provided with two convex connection components 321 on its top.

Two convex connection components 321 are disposed at locations respectively corresponding to the position lock and position shift assembly 1 and the controlling assembly 2, and respectively utilized to embed the position knob 203 and the key cylinder 21. Through holes are disposed respectively in the center of each convex connection component 321. The switching shaft 202 penetrates the left through hole and then attaches to the position knob 203; the key cylinder 21 penetrates the right through hole and then inserts into the control cam 22.

Figure 9:
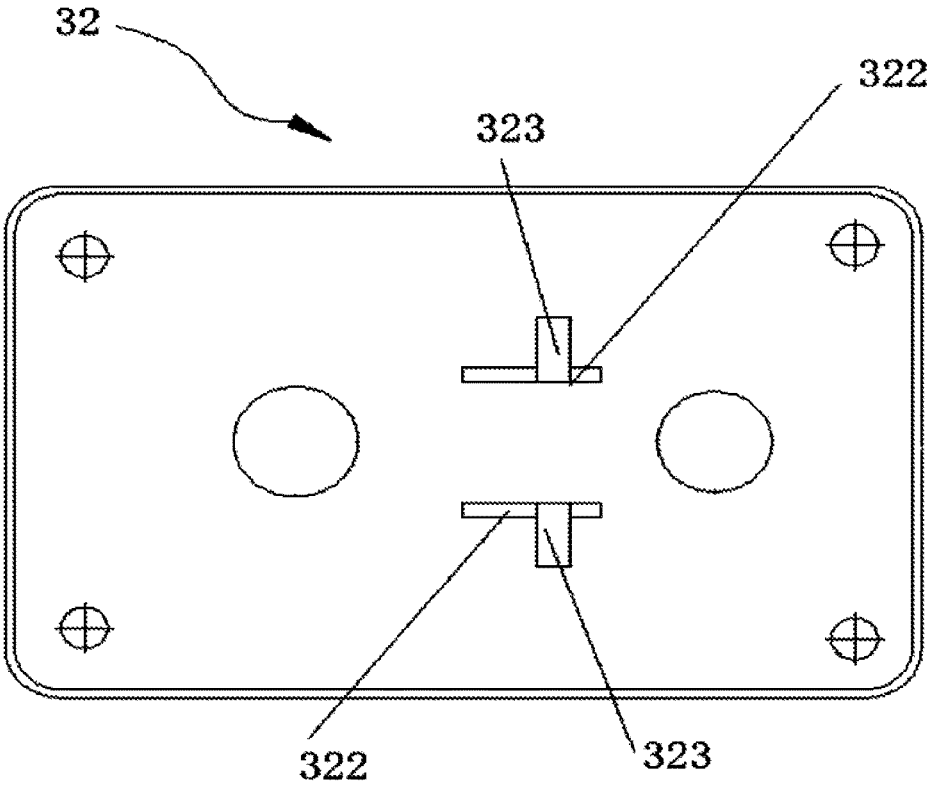
FIG. 9 is a bottom view of FIG. 8.

FIG. 9 is a bottom view of FIG. 8.

As shown by FIG. 9, the cover body 32 is provided with a guiding rail 322 and a location limiting plate 323 on its bottom.

The guiding rail 322 is disposed at a location corresponding to the guiding groove 313, and is in the same direction as the guiding groove 313. The location limiting plate 323 is disposed at a location corresponding to the pushing assembly 314.

Figure 10:
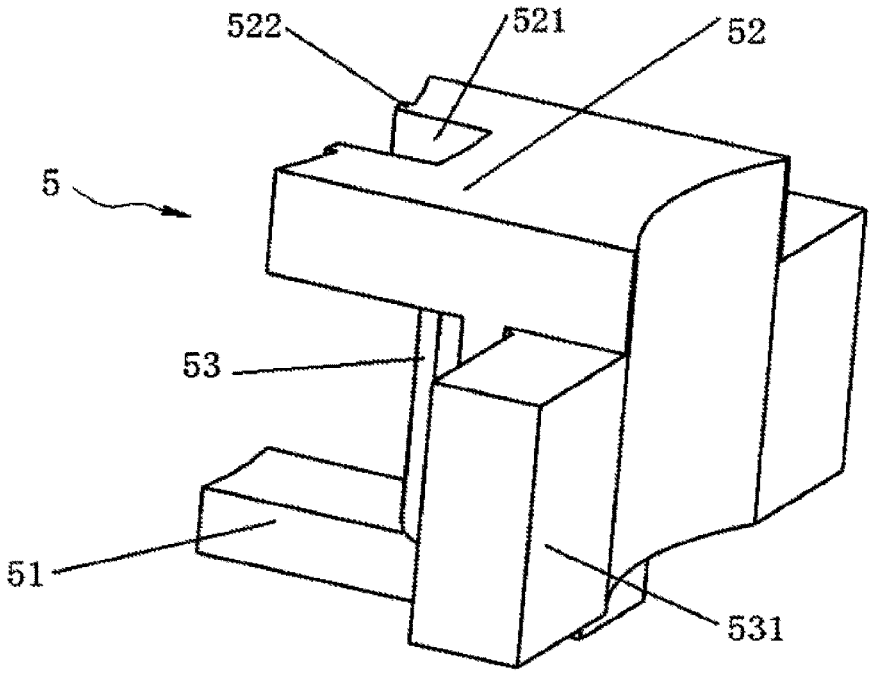
FIG. 10 is a structural illustration of the moving body in the embodiment.

FIG. 10 is a structural illustration of the moving body in the embodiment.

As shown by FIG. 10, the moving body 5 is provided with a resist lever 51, a mesh top 52 and a connection body 53.

The pushing lever 51 can slide in the space between the roundel pedestal 41 and the bottom of the box body 31, and can push the axial projection 4311 to move along a through-hole 415 by the guide of the guiding groove 313. A lock groove 521 is disposed on a contact part, where the mesh top 52 contacts to the inner core component 43, of the mesh top 52. A mesh tooth 522 is disposed respectively on each side of the mesh top 52, and is corresponding to the lock groove 521. The connection body 53 is disposed between the pushing lever 51 and the mesh top 52, and is provided with an arc surface which bulges towards the locked body 4. The moving body 5 is provided with a sunken arc surface corresponding to the control cam 22 on the contact surface. The connection body 53 is provided with a pushing body 531 on both sides, which are in a direction vertical to the guiding groove 313. The pushing body 531 pushes the pushing spring 3142 towards the spring locating component 3141. And the guiding groove 313 in FIG. 7 is utilized to guide the pushing lever 51 to move towards and push an axial projection 4311 on the inner core component 43. The guiding rail 322 in FIG. 9 is utilized to guide the lock groove 521 to move towards the location tooth 421 in FIG. 9.

Figure 11:
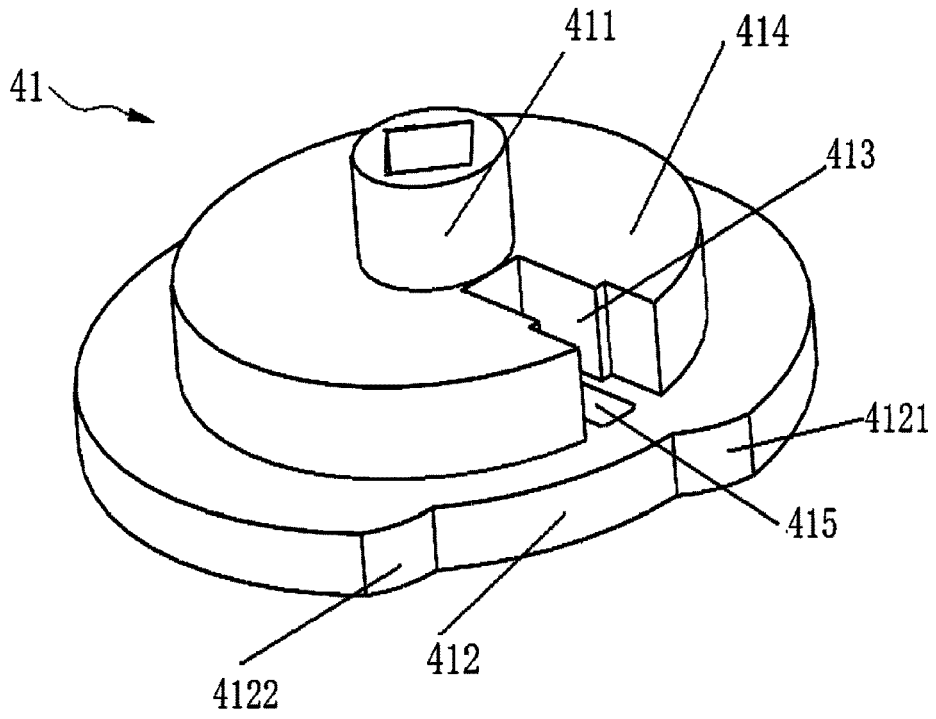
FIG. 11 is a structural illustration of the roundel pedestal in the embodiment.

FIG. 11 is a structural illustration of the roundel pedestal in the embodiment.

As shown in FIG. 11, the roundel pedestal 41 is a rotary body, and is provided with a setup fixation section 411, a notch 412, an axial slot 413 and a convex base platform 414.

The setup fixation section 411 is disposed in the rotary center of the roundel pedestal 41, and is penetrated by the switching shaft 202. The setup fixation section 411 is provided with a square through hole corresponding to the cross section of the switching shaft 202, and allows the roundel pedestal 41 to be fixed onto the switching shaft 202, so that the roundel pedestal 41 can rotate synchronously with the switching shaft 202. The notch 412 is a notch of a preset 45 degree angle, and is disposed on the edge of the roundel pedestal 41. The axial slot 413 extends parallelly along the axial direction of the switching shaft 202, and is disposed between the notch 412 and the setup fixation section 411. The convex base platform 414 is cylinder-shaped, and is disposed on the surface, where is close to the lock tooth component 42, of the roundel pedestal 41. The axial slot 413 is provided with a through-hole 415, which extends along the radial direction of the roundel pedestal 41, therefore the inner core component 43 is aligned with a first sidewall 4121 on the right side of the notch 412. The setup fixation section 411 is disposed on the top of the convex base platform 414, and is rotatably attached to the lock tooth component 42.

When the multi-position shifting switch 200 is in the automation control mode position 211, the first sidewall 4121 contacts with the arc surface on the connection body 53. And when the multi-position shifting switch 200 is in the stop control mode position 212, a second sidewall 4122 contacts with the arc surface on the connection body 53. Such structure of the notch 412 ensures that the notch 412 can face the moving body 5 whether the multi-position shifting switch 200 is in the automation control mode position 211 or the stop control mode position 212. When the switching shaft 202 is rotated, the notch 412 restricts the roundel pedestal 41 to rotate only a preset angle about the lock tooth component 42.

Figure 12:
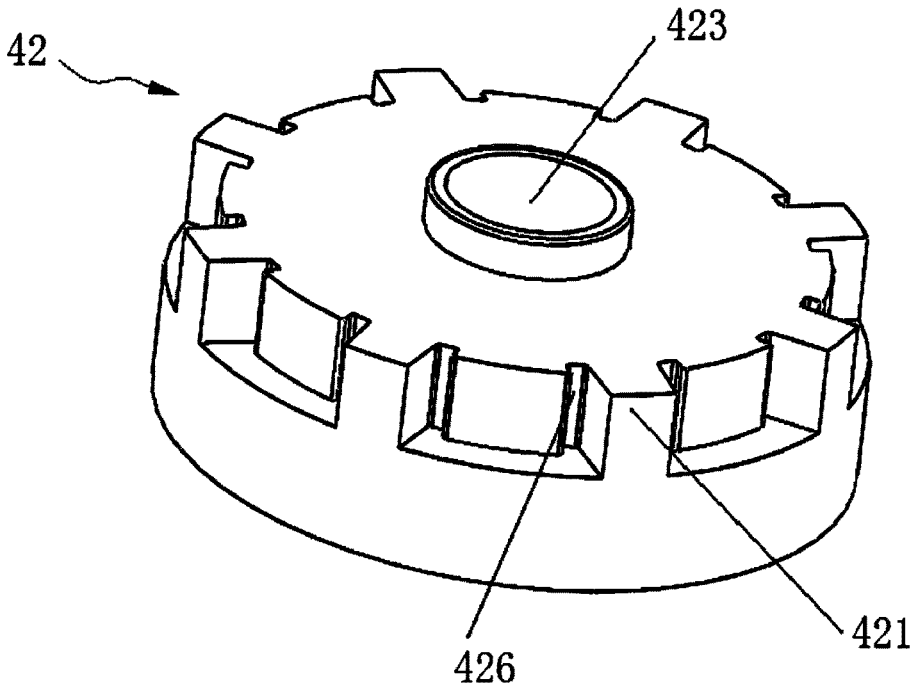
FIG. 12 is a top structure illustration of the lock tooth component in the embodiment.

FIG. 12 is a top structure illustration of the lock tooth component in the embodiment.

Figure 13:
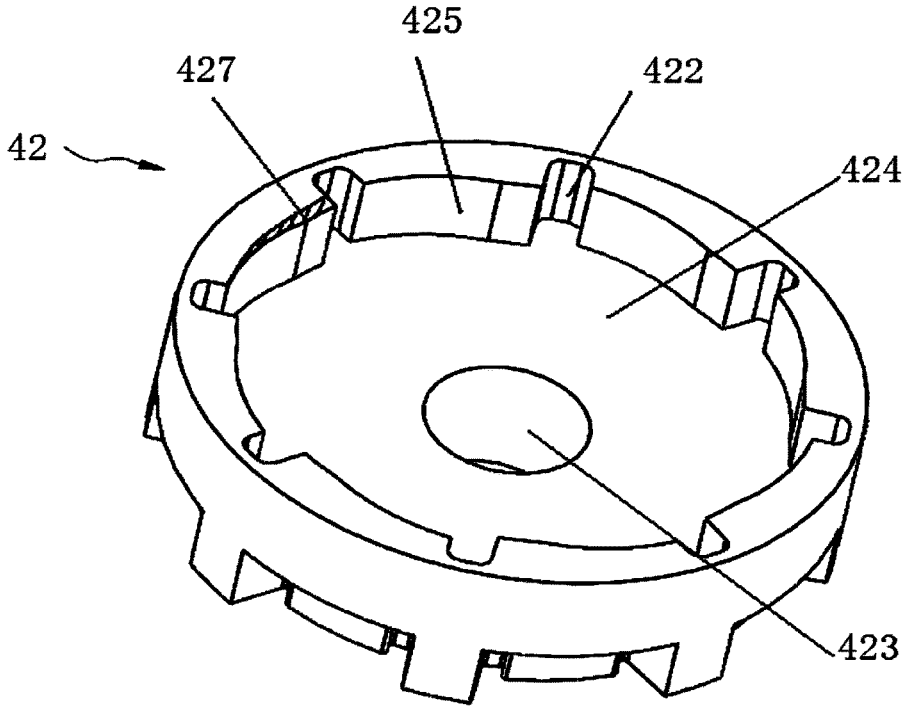
FIG. 13 is a bottom structure illustration of the lock tooth component in FIG. 12.

FIG. 13 is a bottom structure illustration of the lock tooth component in the embodiment.

As shown by FIG. 12 and FIG. 13, the lock tooth component 42 is roundel-shaped, and is provided with eight location teeth 421, eight radial slots 422, a location hole section 423, an inner groove 424 and eight blocking sections 427.

The location hole section 423 is disposed in the axial center of the lock tooth component 42, and is utilized to fit with the setup fixation section 411 rotatably. There is a gap between the location hole section 423 and the setup fixation section 411, thus the lock tooth component 42 could rotate about the roundel pedestal 41.

The multi-position shifting switch 200 is composed of eight control modes with preset intervals of 45 degree angle. Around the axial center of the lock tooth component 42, the eight location teeth 421 are evenly distributed on the top of the lock tooth component 42 with corresponding preset intervals of 45 degree angle. The lock groove 521 is utilized to fit with the location tooth 421. The lock tooth component 42 is provided with a mesh groove 426 respectively at both downsides of each location tooth 421. The mesh groove 426 meshes with the mesh tooth 522 of the mesh top 52. The guiding rail 322 is utilized to guide the lock groove 521 to fit with the location tooth 421.

As shown by FIG. 13, the inner groove 424 is disposed at the bottom of the lock tooth component 42, and the lock tooth component 42 covers the convex base platform 414 into the inner groove 424. Each radial slot 422 is corresponding to each location tooth 421, and the radial slots 422 are evenly disposed in a circle at the bottom of the lock tooth component 42.

A slop arc surface 425 is disposed between each two adjacent radial slots 422, and all slop arc surfaces 425 have different circle centers. Eight slop arc surfaces 425 surround together to form the side wall of the inner groove 424. As shown by the shadow part in the figure, the blocking sections 427 are respectively disposed between each two adjacent radial slots 422. In the present embodiment, there are eight blocking sections 427, and the figure shows only one of them while the others are omitted.

Figure 14:
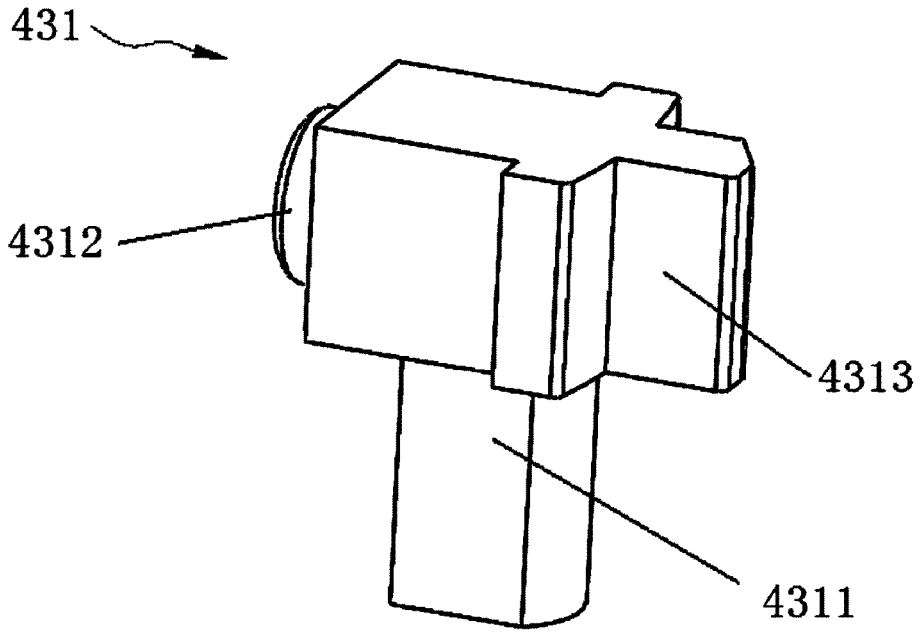
FIG. 14 is a structural illustration of the fit member 431 in the embodiment.

FIG. 14 is a structural illustration of the fit member 431 in the embodiment.

As shown by FIG. 14, the fit member 431 is provided with: an axial projection 4311, a location side portion 4312 and a radial projection 4313.

The axial projection 4311 is utilized to fit the axial slot 413, and the bottom part of the axial projection 4311 extends out from the bottom of the axial slot 413 through the through-hole 415. The pushing lever 51 pushes the extension part of the axial projection 4311 to move along the through-hole 415. The radial projection 4313 is disposed on the side, which faces the radial slot 422, of the axial projection 4311, and is utilized to be fit into the radial slot 422. The location side portion 4312 is disposed on the side, which faces the switching shaft 202, of the axial projection 4311, and is utilized to cover the forcing member 432. As a forcing unit, the forcing member 432 pushes the radial projection 4313 and actuates the radial projection 4313 to insert into the radial slot 422 smoothly.

Figure 15:
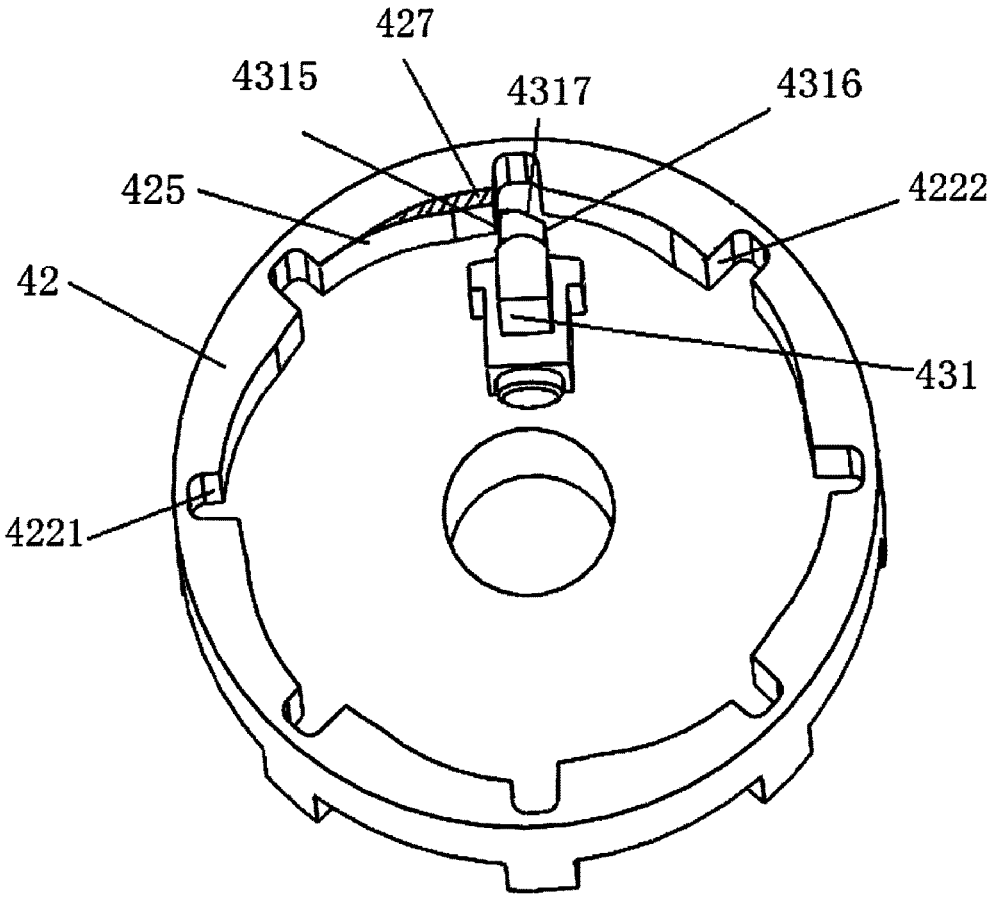
FIG. 15 is a diagram showing the connection of the fit member and the lock tooth component.

FIG. 15 is a diagram showing the connection of the fit member and the lock tooth component.

As shown in FIG. 15, each radial slot 422 is provided with two sidewalls 4221, which are parallel with each other. From one of the sidewalls 4221, a block sidewall 4222 extends along the radial direction of the lock tooth component 42.

Each end of the slop arc surface 425 is attached to an adjacent block sidewall 4222 and an adjacent sidewall 4221 respectively. The block sidewall 4222 and the attached slop arc surface 425 form the blocking section 427, as shown by the shadow part in the figure.

The radial projection 4313 is provided with a long location side portion 4315 corresponding to the block sidewall 4222, a short location side portion 4316 corresponding to the sidewall 4221, and an arc connection portion 4317 whose two ends attach the long location side portion 4315 and the short location side portion 4316 respectively.

When the radial projection 4313 on the fit member 431 is fit into the radial slot 422, the inner core component 43 connects the roundel pedestal 41 and the lock tooth component 42 together. Therefore when the switching shaft 202 is rotated, the roundel pedestal 41 and the lock tooth component 42 can rotate in synchronism.

When the multi-position shifting switch 200 is set in the automation control mode position 211, the notch 412 aligns with the moving body 5. When the moving body 5 is pushed towards the locked body 4, the lock groove 521 and the location tooth 421 fit and lock each other, thus the lock tooth component 42 is locked by the moving body 5. Then the axial projection 4311 of the axial slot 413 is pushed by the pushing lever 51 on the moving body 5, and separates the radial projection 4313 from the radial slot 422. Therefore the short location side portion 4316 is separated from the sidewall 4221, and the long location side portion 4315 contacts the blocking section 427, as the status shown in FIG. 15. The radial projection 4313 is separated from the radial slot 422, and the blocking section 427 prevents the roundel pedestal 41 actuating the radial projection 4313 to rotate from the automation control mode position 211 to the direction of the manual control mode position 218. Thereby the roundel pedestal 41 can rotate about the lock tooth component 42 only from the automation control mode position 211 to the direction of the stop control mode position 212.

In the case of emergency, the multi-position shifting switch 200 needs to be shifted into the stop control mode position 212, however the key 21*a* to unlock may be lost or cannot be inserted, so the lock tooth component 42 is locked by the moving body 5 and cannot rotate. The switching shaft 202 can actuate the roundel pedestal 41 to rotate about the lock tooth component 42 from the automation control mode position 211 to the direction of the stop control mode position 212. Then the arc connection portion 4317 of the radial projection 4313 moves clockwise along the slop arc surface 425 and then slides to the next adjacent radial slot 422, as the radial slot 422 on the right of the fit member 431 shown in FIG. 15. Meanwhile the arc connection portion 4317 is separated from the slop arc surface 425. Since the notch 412 restricts the roundel pedestal 41 to rotate a preset angle of 45 degree about the lock tooth component 42 and then stops the rotation, the radial projection 4313 is thus pushed into the adjacent the radial slot 422 with the push force of the forcing member 432, and then stops sliding. At this time, the radial projection 4313 fits with the radial slot 422, and the fit member 431 connects the roundel pedestal 41 and the lock tooth component 42 into one, thus the rotation of the roundel pedestal 41 is stopped. The multi-position shifting switch 200 is consequently shifted into the stop control mode position 212 with the lock tooth component 42 locked.

After the emergency is relieved, when the multi-position shifting switch 200 needs to be unlocked from the stop control mode position 212, the key 21*a* needs to be inserted into the key cylinder 21 and actuates the control cam 22 to deflect to the status as shown in FIG. 4. Then the pushing assembly 314 pushes the moving body 5 towards the controlling assembly 2, and the lock groove 521 separates from the location tooth 421. At this time, the radial projection 4313 is fit in the radial slot 422 and the axial projection 4311 is fit in the through-hole 415, so when the position knob 203 is rotated, the inner core component 43 can lead the lock tooth component 42 and the roundel pedestal 41 rotate in synchronism. Therefore the multi-position shifting switch 200 is unlocked from the lock status.

Figure 16:
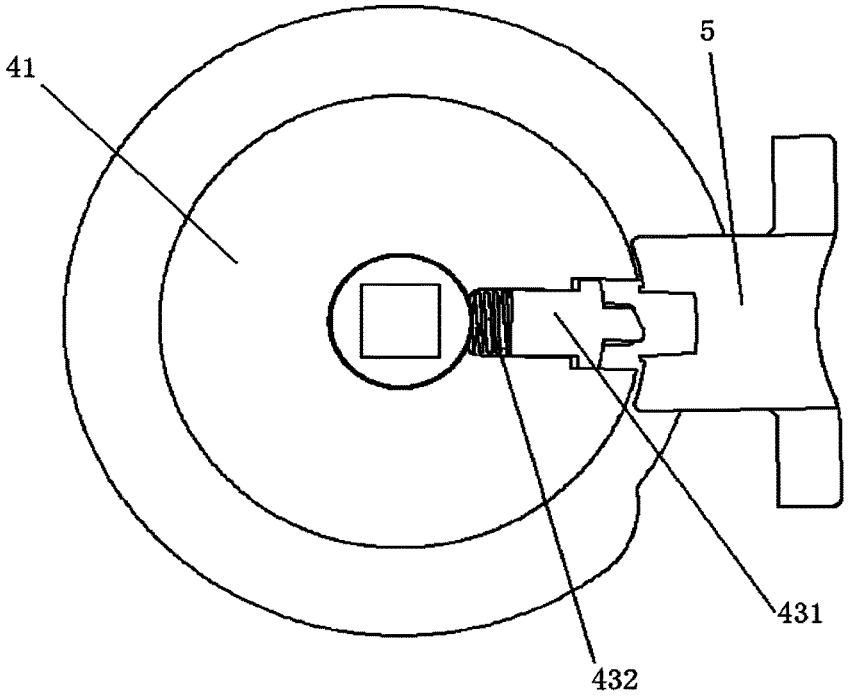
FIG. 16 is a location illustration of the inner core component when the multi-position shifting switch is in the automation control mode position.

FIG. 16 is a location illustration of the inner core component when the multi-position shifting switch is in the automation control mode position.

When the multi-position shifting switch 200 is in the stop control mode position 212 and needs to be locked, the control cam 22, as shown in FIG. 4, is rotated a 90 degree and actuates the moving body 5 to move towards the locked body 4. Therefore the lock groove 521 and the location tooth 421 fit and lock each other, and then the radial slot 422, which is corresponding to the automation control mode position 211, aligns with the moving body 5. Meanwhile the pushing lever 51 pushes the axial projection 4311, and the fit member 431 moves towards the switching shaft 202 with the push force of the resist lever 51. At this time, the forcing member 432 is compressed, and the radial projection 4313 separates from the radial slot 422, therefore the roundel pedestal 41 can rotate about the lock tooth component 42.

Figure 17:
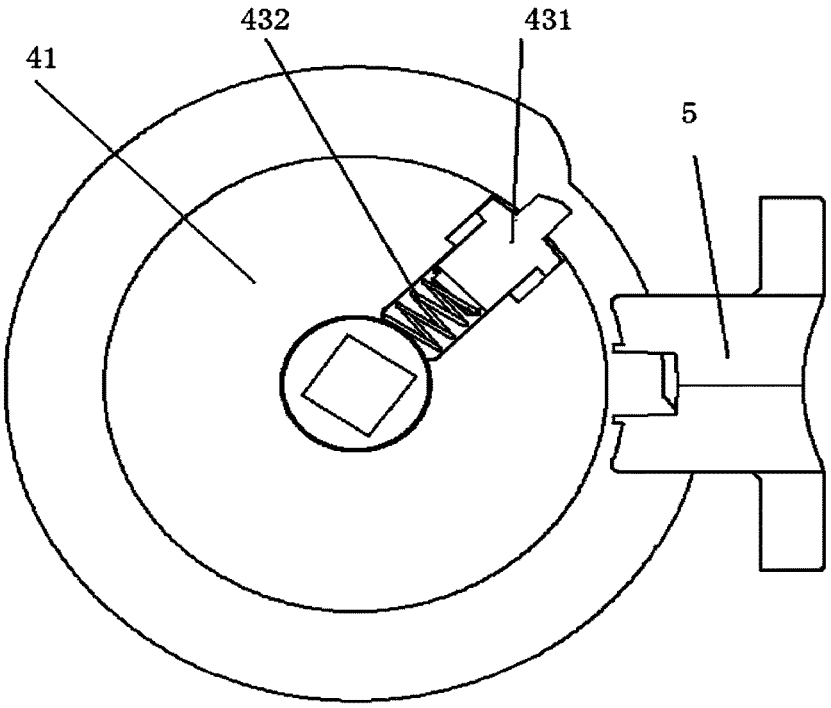
FIG. 17 is a location illustration of the inner core component when the multi-position shifting switch is in the stop control mode position.
Figure 18:
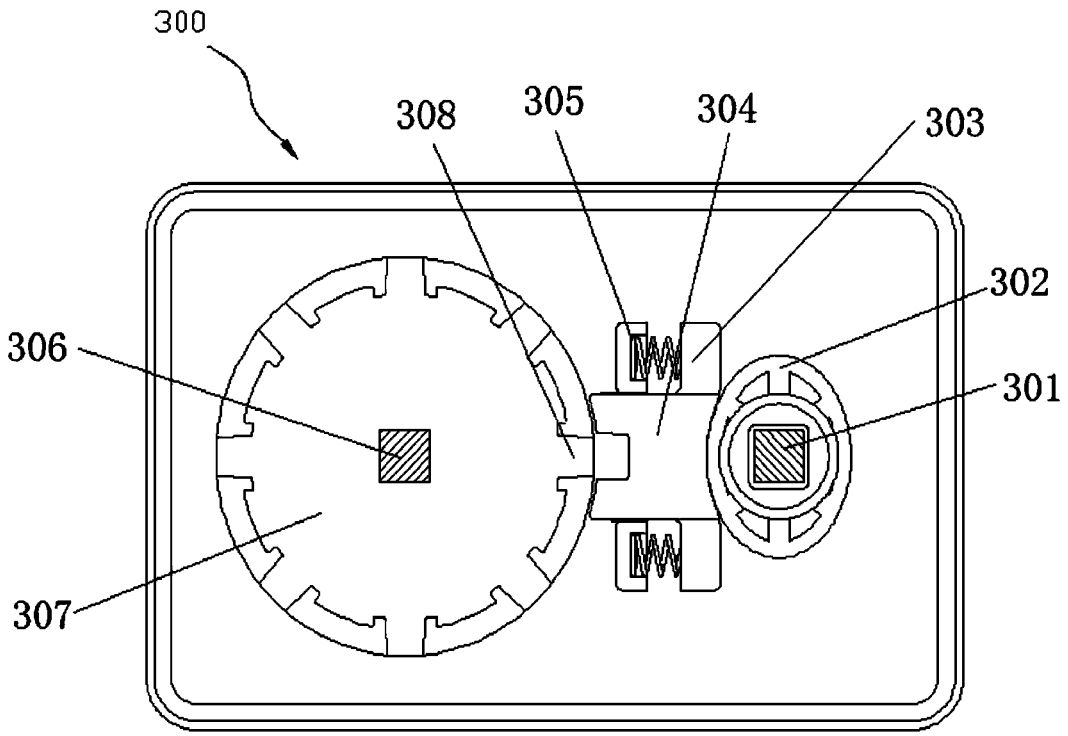
FIG. 18 is a structural illustration of the locking mechanism in prior art.

In the case of emergency, when the multi-position shifting switch 200 needs to be shifted into the stop control mode position 212, the switching shaft 202 is rotated along the anticlockwise direction as the figure, and the roundel pedestal 41 is actuated to rotate synchronously to a status shown as FIG. 17. At this time, the lock tooth component 42 is locked by the moving body 5, and the lock groove 521 is still fit and locked by the location tooth 421. Thus the radial projection 4313 pushes the slop arc surface 425 to slide to the next radial slot 422, which is anticlockwise adjacent with the former radial slot 422. The multi-position shifting switch 200 is consequently shifted into the stop control mode position 212.

FIG. 17 is a location illustration of the inner core component when the multi-position shifting switch is in the stop control mode position.

As shown in FIG. 17, when the multi-position shifting switch 200 is in the stop control mode position 212, the pushing lever 51 is separated from the axial projection 4311 and the fit member 431 loses the push force of the resist lever 51. Thus the forcing member 432 is released to an extension status, and then pushes the fit member 431 away along the radial direction of the roundel pedestal 41. The radial projection 4313 is thus actuated to fit with the radial slot 422. At this time, the roundel pedestal 41 and the lock tooth component 42 are connected by the inner core component 43. Since the lock tooth component 42 is still locked by the moving body 5, the switching shaft 202 cannot rotate.

After the emergency is relieved, when the multi-position shifting switch 200 needs to be unlocked from the stop control mode position 212, the key 21*a* is inserted into the key cylinder 21 to actuate the control cam 22 to deflect reversely as the status shown in FIG. 4. Thus the pushing assembly 314 pushes the moving body 5 towards the controlling assembly 2, and actuates the lock groove 521 to separate from the location tooth 421. The position lock and position shift assembly 1 is thereby unlocked. Then the switching shaft 202 is rotated to unlock the multi-position shifting switch 200 from the stop control mode position 212. At this time, the roundel pedestal 41 and the lock tooth component 42 rotate in synchronism.

Function and Effects of the Present Embodiment

According to position lock and position shift controlling mechanism 100 provided in the present embodiment, when the multi-position shifting switch 200 is shifted and locked into the automation control mode position 211, the lock groove 521 fit with the location tooth 308, thus the lock tooth component 42 is locked by the moving body 5 and cannot move. Meanwhile the pushing lever 51 pushes the axial projection 4311 towards the switching shaft 202, and actuates the radial projection 4313 of the inner core component 43 to separate from the radial slot 422, therefore the roundel pedestal 41 can rotate about the lock tooth component 42. In the case of emergency, if the key 21*a* was lost, or the key 21*a* cannot be inserted in time, or the key 21*a* cannot be inserted, the switching shaft 202 can be rotated to actuate the roundel pedestal 41 to rotate about the lock tooth component 42 from the automation control mode position 211 to the stop control mode position 212. After the multi-position shifting switch 200 is shifted into the stop control mode position 212, the lock tooth component 42 is locked by the moving body 5, so the switching shaft 202 cannot be rotated to shift the position, thus the multi-position shifting switch 200 is locked in the stop control mode position 212. After the emergency is relieved, the key 21*a* can be inserted into the controlling assembly 2 and can actuate the controlling cam 302 to deflect and to separate the moving body 5 from the lock tooth component 42. Therefore the switching shaft 202 can be rotated and the multi-position shifting switch 200 is unlocked from the stop control mode position 212.

When the mesh teeth 522 on both sides of lock groove 521 mesh with the mesh grooves 426 on both sides of the location tooth 421, the mesh groove 426 and the location tooth 421 can fit more tightly.

The block sidewall 4222 and the connected slop arc surface 425 constitute the blocking section. And the blocking section 427 can prevent the radial projection 4313, which is separated from the radial slot 422, being actuated to rotate towards the manual control mode positions group by the roundel pedestal 41. Therefore the multi-position shifting switch 200 can only shift to the stop control mode position 212 from the automation control mode position 211, when the multi-position shifting switch 200 is locked in the automation control mode position 211.

The above-mentioned embodiment is the optimal technical solution of the present invention. Of course, the position lock and position shift controlling mechanism is not just limited in the structure of the above-mentioned embodiment.

In the present embodiment, the inner core component 43 is constituted with the fit member 431 and the forcing member 432. And in the present invention, the inner core component 43 also can be an integrated component with a forcing part.

In the present embodiment, the preset intervals are angles of 45 degree, so the lock tooth component 42 comprises eight location teeth 421. In position lock and position shift controlling mechanism 100 of the present invention, the number of the location teeth can be adjusted according to preset intervals of different angles.

What is claimed is:

1. A position lock and position shift controlling mechanism to control position locking and position shifting of a multi-position shifting switch, said multi-position shifting switch connects with a plurality of equipment and is provided with at least an automation control mode position to control operation of said plurality of equipment by a computer, a stop control mode position, adjacent to said automation control mode position in a preset interval, to stop operation of said plurality of equipment, and a switching shaft to perform a position shift within said automation control mode position and said stop control mode position, the position lock and position shift controlling mechanism comprising:

a position lock and position shift assembly configured to lock said automation control mode position and to shift said multi-position shifting switch from said automation control mode position to said stop control mode position at a lock status;

a controlling assembly configured to perform a lock control with respect to said position lock and position shift assembly;

wherein said position lock and position shift assembly comprises a locked body disposed on said switching shaft, and a moving body controlled by said controlling assembly to move towards and to lock said locked body;

wherein said locked body comprises: a roundel pedestal, disposed on a switch body, rotating synchronously with said switching shaft; a notch based on said preset interval; a lock tooth component, which is roundel-shaped and is rotatably attached to said roundel pedestal; and an inner core component, disposed between said roundel pedestal and said lock tooth component, configured to synchronously rotate said roundel pedestal and said lock tooth component;

wherein said roundel pedestal comprises an axial slot extending parallel along an axial direction of said switching shaft, said axial slot comprising a through-hole extending along a radial direction of the roundel pedestal;

wherein said lock tooth component comprises a plurality of location teeth evenly distributed with preset intervals; and a plurality of radial slots, each radial slot corresponding to a different location tooth;

wherein said inner core component comprises an axial projection configured to fit said axial slot; a radial projection configured to fit with a radial slot; and a forcing member configured to apply a force on said radial projection to insert said radial projection into said radial slot;

wherein said moving body comprises a lock groove configured to fit a location tooth; and a pushing lever configured to push said radial projection to move along said through-hole;

wherein said controlling assembly comprises a control cam configured to rotatably push said moving body towards said locked body;

wherein said roundel pedestal and said lock tooth component synchronously rotate in response to said radial projection being fitted into said radial slot;

wherein in response to said automation control mode position being set so that said notch aligns with said moving body and said moving body moves towards said locked body, said lock groove and said location tooth fit and lock each other, and said pushing lever pushes said axial projection to separate said radial projection from said radial slot, thereby allowing said roundel pedestal to rotate freely about said lock tooth component; and wherein in response to a rotation of said switching shaft, said notch restricts rotation of said roundel pedestal to one preset interval about said lock tooth component so that said axial projection fits into said axial slot, thereby shifting said multi-position shifting switch into said stop control mode position.

2. The position lock and position shift controlling mechanism according to claim 1, wherein said roundel pedestal further comprises a setup fixation section configured to mount said switching shaft fixedly; and wherein said lock tooth component further comprises a location hole section configured to rotatably fit said setup fixation section.

3. The position lock and position shift controlling mechanism according to claim 1, wherein said switching shaft further comprises a manual control mode position adjacent to said automation control mode position and disposed on an opposite side of said stop control mode position; and wherein each said radial slot further comprises a blocking section configured to prevent said radial projection from being actuated to rotate towards said manual control mode position in response to a separation of said radial projection from said radial slot.

4. The position lock and position shift controlling mechanism according to claim 3, wherein said axial projection further comprises a long location side portion corresponding to said blocking section; a short location side portion corresponding to a sidewall of said radial slot, said sidewall facing said blocking section; and an arc connection portion configured to connect said long location side portion and said short location side portion.

5. The position lock and position shift controlling mechanism according to claim 1, wherein said moving body further comprises a mesh tooth on both sides of said lock groove; and wherein said lock tooth component further comprises two mesh grooves disposed on both sides of each location tooth and corresponding to said mesh teeth.

6. The position lock and position shift controlling mechanism according to claim 1, wherein said position lock and position shift assembly further comprises a housing body configured to mount said locked body and said moving body; wherein said housing body comprises a box body and a cover body configured to cover said box body; wherein said box body comprises a guiding groove configured to guide said pushing lever to move towards said axial projection, and a setup platform configured to mount said roundel pedestal to keep said roundel pedestal a distance from a bottom of said box body; and wherein said cover body comprises a guiding rail in a same direction as said guiding groove, said guiding rail is configured to guide said guiding groove to move towards said location tooth.

* * * * *